United States Patent [19]

Beyens

[11] 4,212,414

[45] Jul. 15, 1980

[54] LIQUID DISPENSING HEAD WITH RINSING FLUID INLET AND INSTALLATION

[75] Inventor: Jozef Beyens, Ruisbroek Aan De Rupel, Belgium

[73] Assignee: Konstruktie J. Lambrechts p.v.b.a., Ruisbroek Aan De Rupel, Belgium

[21] Appl. No.: 956,358

[22] Filed: Oct. 30, 1978

[51] Int. Cl.² ..... B67D 1/08; B65D 83/00; F37L 37/18

[52] U.S. Cl. ..... 222/148; 134/166 C; 141/91; 222/400.7

[58] Field of Search ..... 141/90, 91; 134/102, 134/166 E, 169 E, 166 C; 137/212; 222/400.7, 400.8, 504, 148

[56] References Cited

U.S. PATENT DOCUMENTS 2,076,262 4/1937 Black ..... 222/400.7 X

FOREIGN PATENT DOCUMENTS 2639918 3/1978 Fed. Rep. of Germany ..... 222/400.7

7610470 3/1977 Netherlands ..... 222/148

*Primary Examiner*—David A. Scherbel

*Attorney, Agent, or Firm*—Salter & Michaelson

[57] ABSTRACT

A dispensing head of the kind adapted to be fitted to a container, such as a beer keg, having a plunger with which the dispensing head co-operates to enable liquid in the container to be dispensed through the outlet of the dispensing head under pressure of carbon dioxide gas supplied to the container through the dispensing head. The dispensing head is provided with an inlet for connection to a source of rinsing water and a valve mechanism which can be operated to cut off the flow of liquid from the container through the outlet and to connect the water inlet to the outlet so that rinsing water flows through the oulet and through any pipe and dispensing tap connected to the outlet, which can thus be rinsed without removing the dispensing head from the container. In a preferred embodiment, the valve mechanism can be remotely operated, using the pressure of the carbon dioxide gas to operate the valve mechanism.

11 Claims, 10 Drawing Figures

LIQUID DISPENSING HEAD WITH RINSING FLUID INLET AND INSTALLATION

Figure 1:
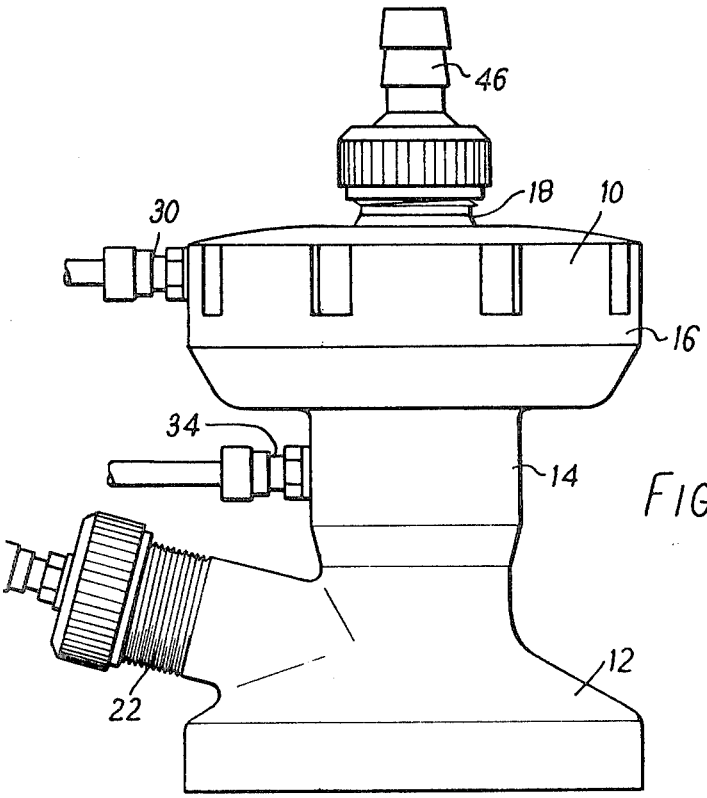

This invention relates to dispensing heads.

More particularly, the invention relates to dispensing heads of the kind adapted to be fitted to a container having a valve plunger with which the dispensing head co-operates to enable liquid in the container to be dispensed through the dispensing head under pressure of a gas supplied to the container through the dispensing head, the dispensing head having inlet means for connection to a source of the pressurising gas and outlet means for connection to a dispensing tap. Such a dispensing head is hereinafter referred to as a dispensing head of the kind set forth.

The invention is particularly, though not exclusively, applicable to dispensing heads for use with kegs from which beer or lager is dispensed under pressure of carbon dioxide supplied through the dispensing head, the dispensing head being connected to a pipe which feeds the beer to a dispensing tap. Such installations are widely used, for example in public houses and restaurants.

A disadvantage of such installations known hitherto is that the dispensing heads and the pipework through which the beer or other beverage is fed from the keg required frequent cleaning.

It is an object of this invention to provide a dispensing head of the kind set forth which enables the head and the associated pipework to be periodically rinsed with water or other suitable fluid.

This invention includes a dispensing head of the kind set forth, in which the dispensing head has further inlet means adapted to be connected to a source of rinsing fluid and valve means movable between a first position in which the further inlet means is closed, the first inlet means is in communication with the interior of the container in which the dispensing head is fitted and the outlet means is in communication with the interior of the container through the valve plunger so that liquid is dispensed from the container, and a second position in which the first inlet means is closed and the outlet means is disconnected from the interior of the container and placed in communication with the further inlet means so that rinsing fluid flows through the outlet means.

Suitably, the valve means comprises a valve member vertically movable in a body of the dispensing head between a first position in which, in use, the valve member engages the valve plunger and holds it in its open position and a second position in which the valve member is disengaged from the valve plunger.

Preferably, the valve member includes a piston movable in a cylinder forming part of the body of the dispensing head, and an inlet to the cylinder is adapted to be connected to the source of pressurising gas so that the pressure of the gas, in use, urges the valve member to its first position.

Suitably, the valve member has a longitudinal channel providing the outlet means, and a one-way valve is positioned in the channel to prevent rinsing fluid from entering the container to which the head is fitted.

The invention also includes a installation for dispensing liquid from a container, comprising a dispensing head as defined above, a source of pressurising gas connected to the first-mentioned inlet means, a source of rinsing fluid connected to the further inlet means, a dispensing tap connected to the outlet means through a length of delivery pipe, and control means operable from a position close to the dispensing tap for controlling the position of the valve means.

Where the valve means is controlled as defined above by means of a supply of the pressurising gas to the control valve of a cylinder forming part of the dispensing head, the control means may include a control valve through which the source of pressurising gas is connected to the control inlet. The control valve may be a manually operated valve positioned close to the dispensing tap. Alternatively, the control valve may be positioned in the region of the dispensing head and source of pressurising gas, the control valve being operated from near the dispensing tap, for example by a further valve connected in a branch line between the source of pressurising gas and the control valve, or by electromagnetic means, the latter being particularly suitable when there is a long distance between the dispensing head and the dispensing tap.

The control valve is preferably also arranged to interrupt the supply of rinsing fluid to the dispensing head when pressurising gas is supplied to the dispensing head. This eliminates the risk of leakage of fluid in the dispensing head contaminating the liquid to be dispensed and is particularly useful when the source of rinsing fluid is at high pressure.

Figure 2:
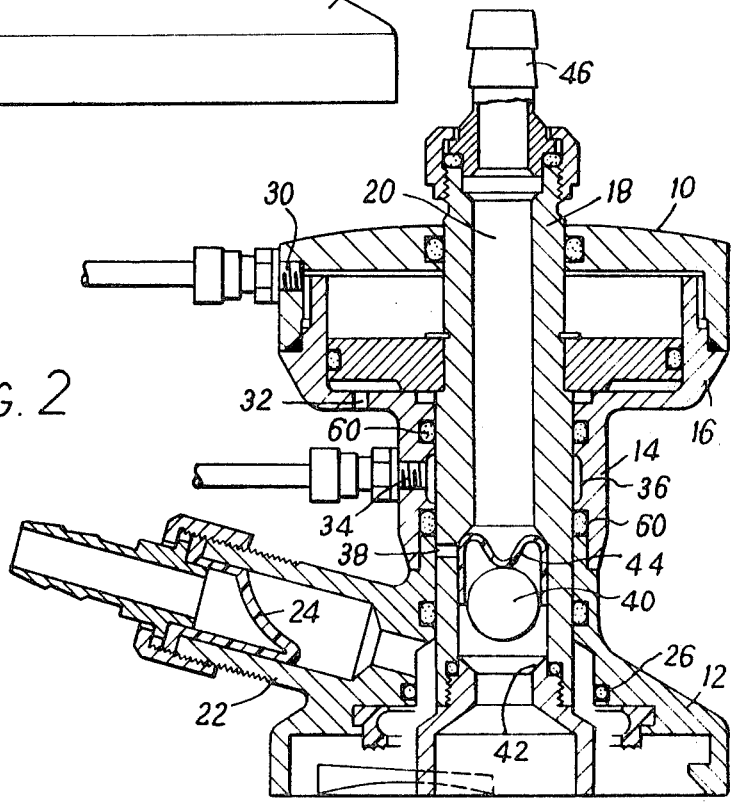
Figure 3:
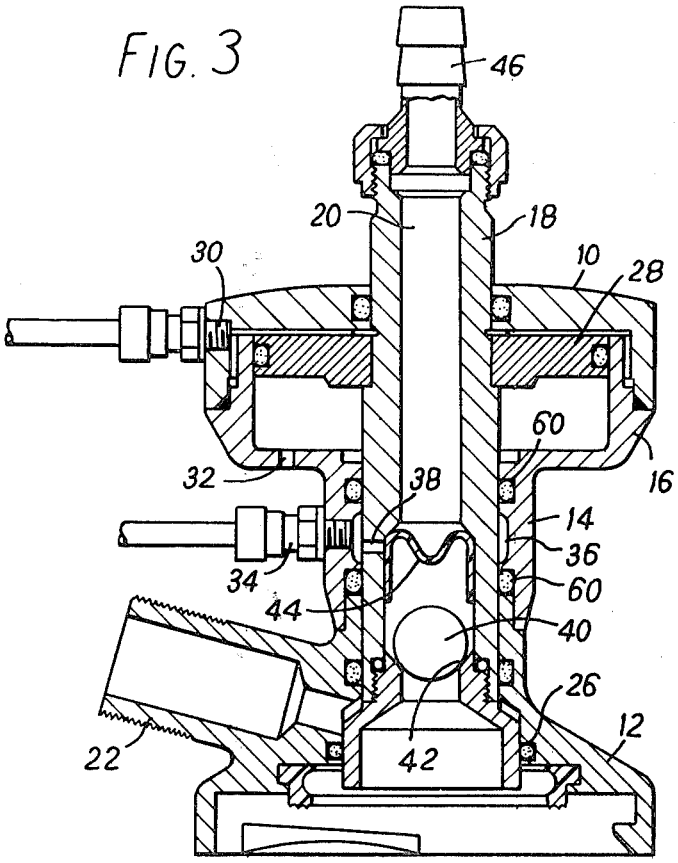
Figure 4:
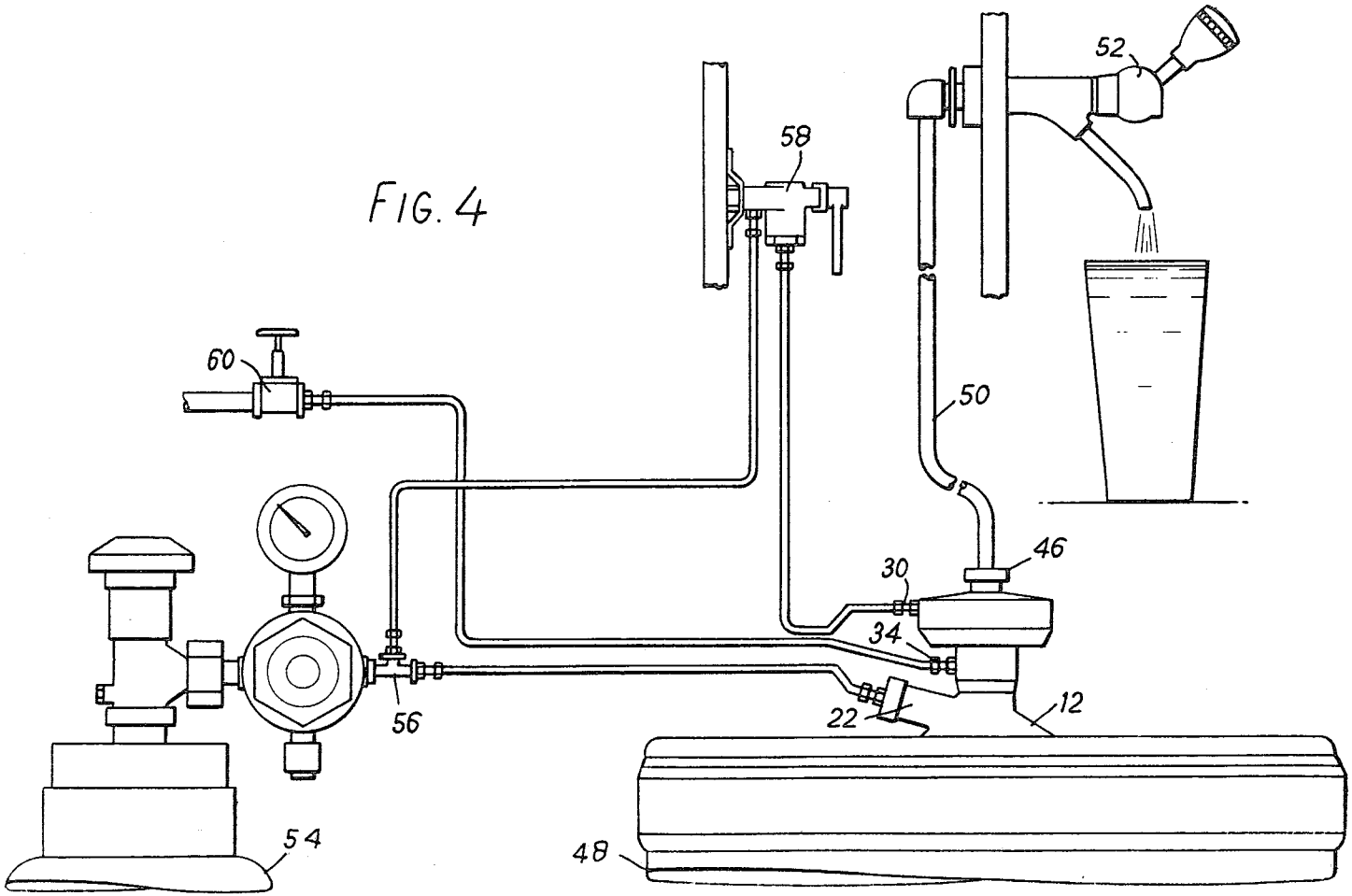
Figure 5:
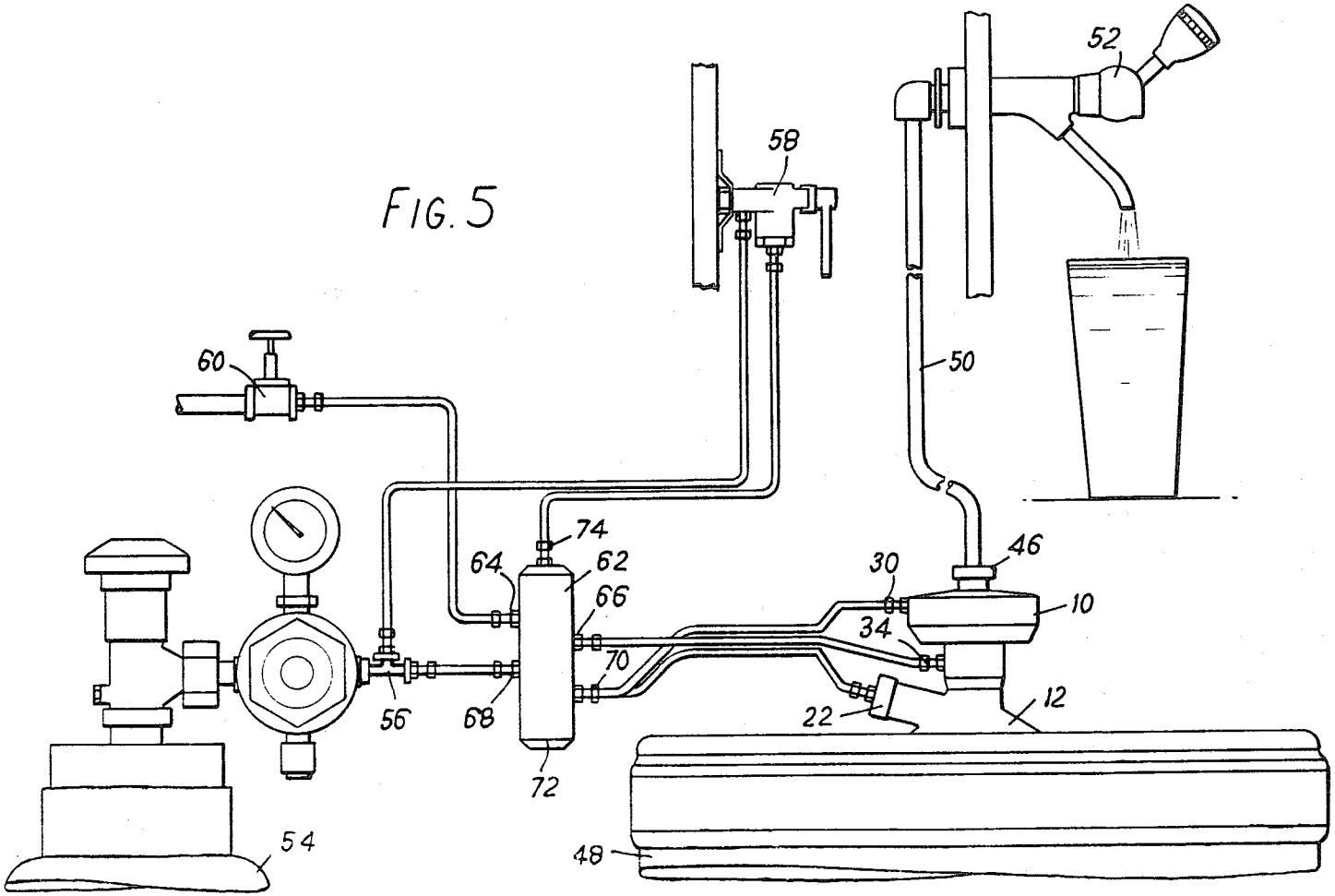
Figure 6:
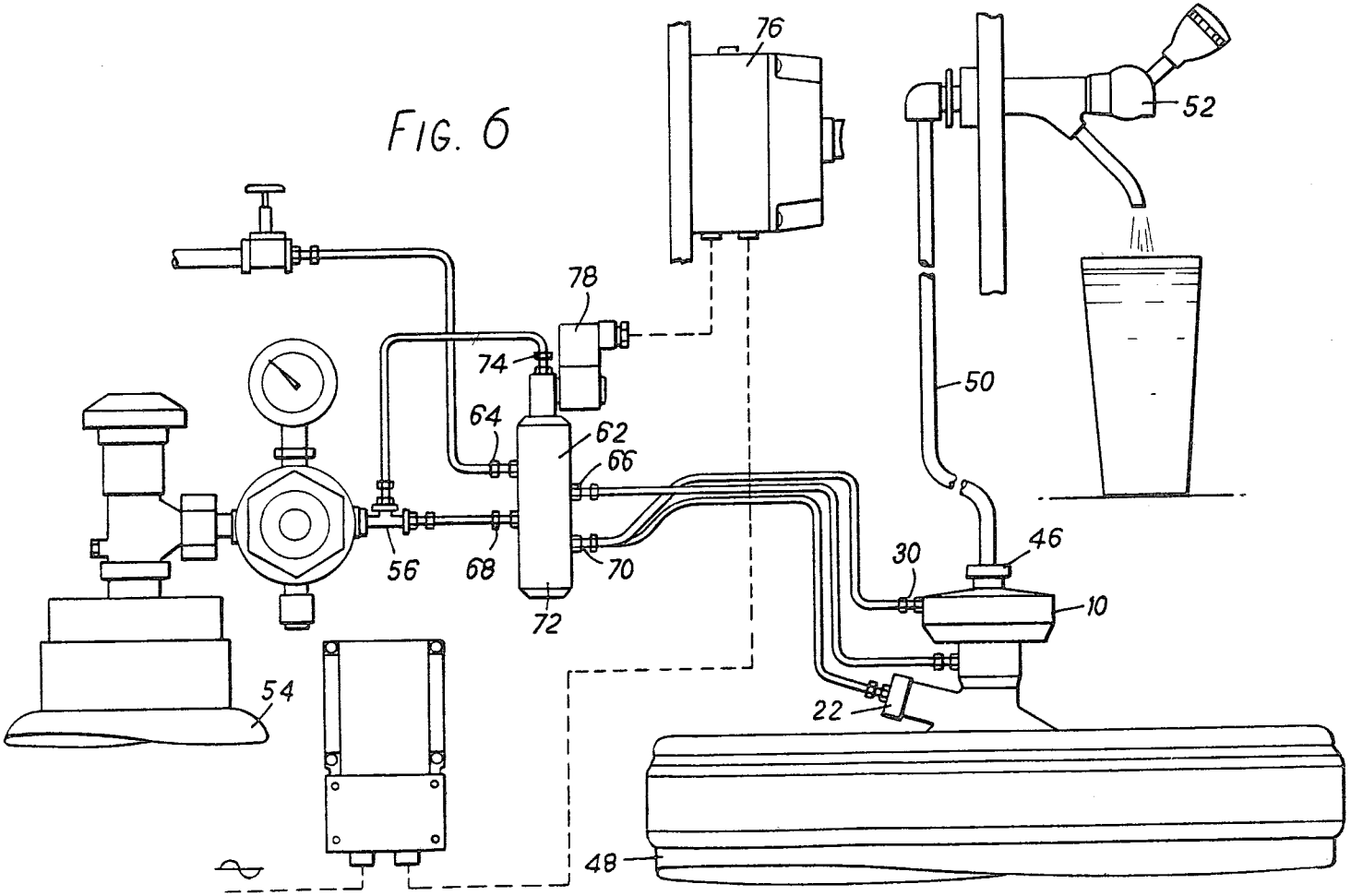
Figure 7:
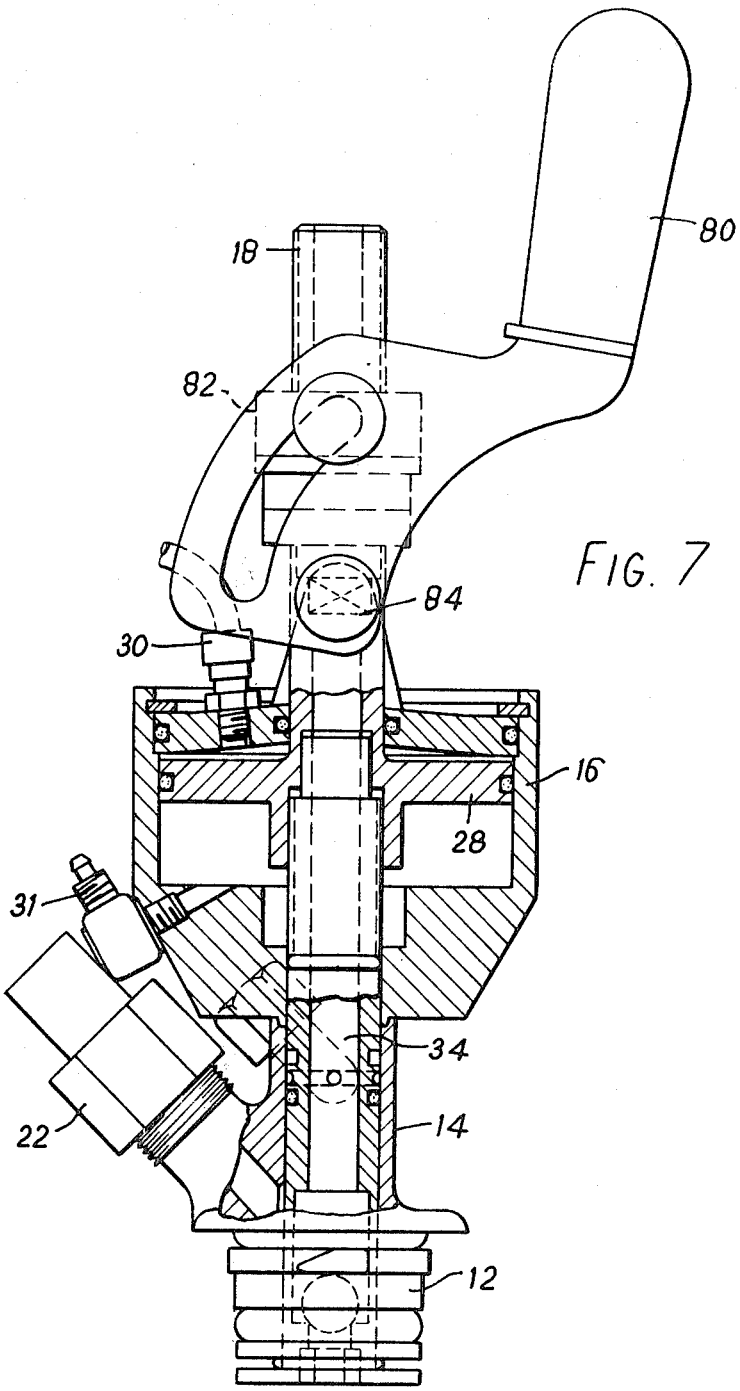
Figure 8:
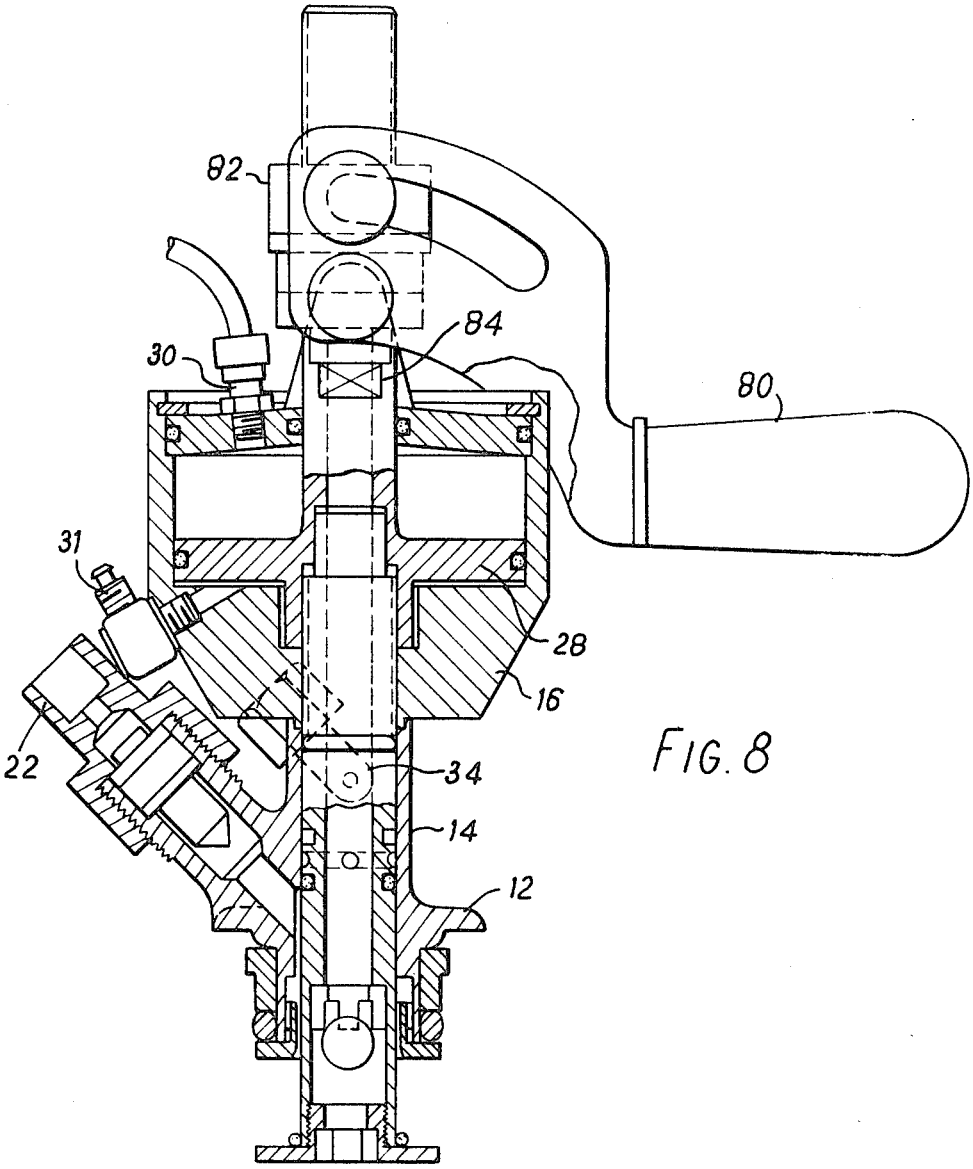
Figure 9:
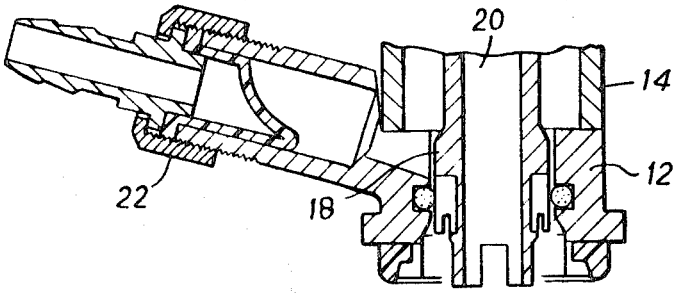
Figure 10:
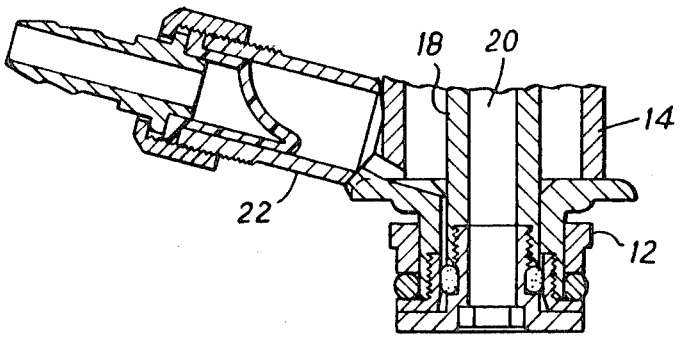

The invention will now be described, by way of example, with reference to the accompanying drawings, in which:

FIG. 1 is a side elevation of a dispensing head constructed in accordance with the invention, FIGS. 2 and 3 are vertical sections through the dispensing head of FIG. 1, showing a valve member of the head in its lowermost and uppermost positions respectively, FIGS. 4, 5 and 6 show respectively three installations employing the dispensing head in accordance with this invention, FIGS. 7 and 8 are vertical cross sections through a dispensing head according to a second embodiment of the invention, and FIGS. 9 and 10 are fragmentary vertical cross sections through dispensing heads modified to co-operate with two different keg tapping systems.

Referring to FIGS. 1 to 3, the dispensing head 10 comprises an adaptor 12 for connection to the tapping hole of a keg, a body 14 fixed to the adaptor and surmounted by a cylinder 16, and a valve member 18 vertically movable relative to the adaptor 12, body 14 and cylinder 16, the valve member having a longitudinally extending channel 20.

The adaptor 12 is shaped to fit onto the mouth of a keg, and the lower part of the valve member 18 is shaped to engage the valve plunger forming part of the keg, when the valve member is in its lowermost position, so that beer from the keg can flow through the channel 20 of the valve member. The various keg tapping systems in use, and the shape of the adaptor and lower part of the valve member necessary for use with each system, will be well known to those skilled in the art.

The adaptor 12 is formed in the usual way with a lateral inlet 22 to which can be connected a pipe supplying carbon dioxide gas under pressure, the gas entering the adaptor through a non-return valve 24 (FIG. 4). When the valve member 18 is in its lowermost position (as shown in FIG. 2) the inlet 22 is, in use, in communication with the interior of the keg, whilst when the valve member is in its uppermost position (as shown in FIG. 3) the inlet 22 is closed by engagement of the valve member with O-ring 26.

Fixed to the valve member 20 is a piston 28 which moves in the cylinder 16, engagement of the piston with the top and bottom internal faces of the cylinder defining the uppermost and lowermost positions of the valve member. An inlet 30 which can be connected to a pipe supplying carbon dioxide under pressure, as described below, opens into the interior of the cylinder 16 at a point above the piston 28, so that supply of gas through the inlet 30 applies pressure to the piston to move the valve member to its lowermost position. The interior of the cylinder 16 below the piston 28 is open to the atmosphere through an aperture 32. The upper part of valve member 18 forms an outler 48 to which can be connected a pipe 50 leading to a dispensing tap 52.

A further inlet 34, which can be connected to a source of rinsing water, opens into an annular channel 36 formed in the inside wall of the body 14 of the dispensing head. When the valve member 18 is in its uppermost position the channel 36 is placed in communication with the channel 20 of the valve member 18 through a bore 38 through the wall of the valve member. When, in use, the valve member is in this position the pressure of rinsing water entering the channel 20 moves the ball 40 of a one-way ball valve provided in the valve member 18 to a lowermost position in which the ball engages a valve seating 42 to prevent the rinsing water from entering the keg. When the valve member 18 is moved to its lowermost position the bore 38 is moved out of alignment with the channel 36 so that the inlet 34 is closed as well as the bore 38. In this position, the ball 40 can be lifted from its seating by pressure of liquid flowing from the keg, the ball moving against a retaining cage 44.

FIG. 4 shows an installation employing the dispensing head of this invention.

The dispensing head 10 is fitted to a keg 48, and the outlet 46 is connected through the pipe 50 to the dispensing tap 52, which is of conventional construction. The pipe 50, which preferably has a maximum interior diameter of 10 mm, may pass in the usual way through a chilling system. The inlet 22 of the adaptor 12 is connected through suitable piping to a cylinder 54 of compressed carbon dioxide, and the inlet 30 of the cylinder 16 of the dispensing head 10 is connected to the same carbon dioxide cylinder through a T-junction 56 and a two-position tap 58 which is located near to the dispensing tap 52. The inlet 34 to the body 14 of the dispensing head is connected through a stopcock 60 to a source of rinsing water which may for example be mains water. The connections to the various pipes are made through suitable unions in the usual way.

In operation of the installation shown in FIG. 4, before the dispensing head is fitted to a full keg, the two-position tap 58 is placed in the "rinsing" position, i.e. the closed position in which no gas is supplied to the cylinder 16. The valve member 18 therefore remains in its uppermost position so that water can enter the channel 20 through inlet 34 and bore 38. The dispensing tap 52 is opened, and rinsing water flows through channel 20, pipe 50 and tap 52. The dispensing head is then fitted to the keg in the usual manner. The two-position tap 58 is then moved to the "dispensing" position, i.e. to the open position in which gas is supplied from the carbon dioxide cylinder 54 to the inlet 30 of cylinder 16. The valve member 18 is thus moved to its lowermost position, the valve plunger incorporated in the keg is opened and gas is supplied through inlet 34 to the interior of the keg as described above so that beer flows through channel 20 and through pipe 50 to the dispensing tap 52. At the same time the rinsing water inlet 30 is closed. Since the rinsing water is automatically cut off as the plunger valve of the keg is opened and as gas inlet 32 is opened, and since the volume between the water inlet and the ball valve 40 is very small, the beer follows the water flowing in pipe 50 without interruption and with no danger of the water mixing with the beer or of an air-lock forming in the pipe. With the two-position tap 58 in the "dispensing position", the dispensing tap 52 is used to control the flow of beer from the keg in the usual manner.

When the keg is empty, and the dispensing head is to be connected to a new keg, the two-position tap 58 is placed in the "rinsing" position, so that the gas pressure to cylinder 16 is cut off. The valve member 18 is consequently moved to its uppermost position under the internal pressure of the keg. The valve member 18 is thus automatically detached from the valve plunger of the keg, and the supply of gas through inlet 22 in adaptor 12 is cut off. At the same time the water inlet is opened so that rinsing water flows through the dispensing head and the pipe 50. The dispensing head is then connected to the new keg, and the two-position tap is moved back to the "dispensing" position to cut off the rinsing water and connect the valve member 18 to the valve plunger of the new keg, as described above.

Since it is necessary to move the two-position tap 58 to the "dispensing" position before the dispensing head is removed from the empty keg, the dispensing head cannot be moved from an empty keg to a full keg without rinsing water automatically flowing through the dispensing head and pipe 50. It is therefore ensured that the dispensing head and pipe are rinsed at least at every change of keg. Also, since the valve member is in its uppermost position there is no danger of leakage of carbon dioxide from the head as it is moved from the empty keg to the new one, and leakage of water is prevented by the valve 40.

In addition, the dispensing head can be operated to rinse the head and pipe 50 and to disconnect the valve member 18 from the keg whenever there is a prolonged interruption in delivery from the keg, overnight for example. To do this, the two-position tap 58 is placed in the "rinsing" position and the dispensing tap 52 is opened until water flows from the dispensing tap. The dispensing tap 52 is then closed, and the two-position tap is left in the "rinsing" position. The valve member 18 is then disconnected from the valve plunger and water remains in the dispensing head and pipe 50 until the two-position tap 58 is again placed in the "dispensing" position when delivery of beer is to be recommenced. It will be apparent that the operations just described can be carried out from a position near the dispensing tap, without the operator having to go to the cellar or room housing the kegs and carbon dioxide cylinder and associated equipment.

In the dispensing head shown in FIGS. 1 to 3, leakage of water or gas between the outer wall of the movable valve member 18 and the inner walls of the adaptor 12, body 14 and cylinder 16 is prevented by the use of a number of suitably positioned O-rings 60. However, if the supply of rinsing water is at a high pressure, there may be a danger of leakage of water from inlet 32 when the valve member is in its lowermost position if one or more of the O-rings fails. FIG. 5 shows an alternative installation which is particularly useful in those circumstances, though it can of course also be used where the water pressure is not high.

In the installation of FIG. 5, the pipe from the water supply is connected to one inlet 64 of a control valve 62 the corresponding outlet 66 of which is connected to the rinsing water inlet 34 of the dispensing head 10, which is identical to that of FIGS. 1 to 3. The main pipe from the carbon dioxide cylinder is connected to a further inlet 68 of the control valve 62, the corresponding outlet 70 being connected to both the gas inlets 22 and 30 of the dispensing head. The control valve 62 is a spool valve the spool of which is biassed by spring 72 to a position in which the water inlet 64 and outlet 66 are closed whilst the gas inlet 68 and outlet 70 are open, so that the valve is normally-open to gas flowing to the dispensing head but normally-closed to water. The spool can be moved from its normal position, to cut off the gas supply to the dispensing head and open the water supply to the head, under pressure of gas supplied to a control inlet 74 at the end of the control valve 62 through the two-position tap 58 which, as in the installation of FIG. 4, is positioned close to the dispensing tap 52 and is connected through a branch pipe to the carbon dioxide cylinder. In the installation of FIG. 5 the "dispensing" position of the tap 58 is the closed position in which no gas is supplied to the control inlet 74 of the control valve so that gas is supplied through the control valve to the gas inlets of the dispensing head to allow beer to be dispensed as described above. At the same time the water supply is disconnected by control valve 62 so that there is no danger of water leaking under pressure in the dispensing head 10. The "rinsing" position of the tap 58 is the open position in which gas is supplied to the control inlet 74 of control valve 62 to move the spool to the position cutting off the gas supply to the dispensing head and allowing rinsing water to flow to the dispensing head. It will be appreciated that even if the gas supply from the carbon dioxide cylinder fails, so that the valve member 18 of the dispensing head moves to its uppermost position, the control valve 62 will cut off the supply of water to the dispensing head since the spool will be moved to its normal position by spring 72.

FIG. 6 shows a further alternative installation which is the same as that of FIG. 5 except that the two-position valve 58 is replaced by an electric control switch 76 which controls a solenoid-operated valve 78 through which the branch line from the carbon dioxide cylinder is connected to the control inlet of control valve 62. This installation is particularly useful when there is a long distance between the dispensing tap and the room housing the kegs and carbon dioxide cylinder, since it avoids a long run of gas piping.

In each of the described installations the ease with which the dispensing head and the pipe leading to the dispensing tap can be rinsed, and the automatic rinsing at each change of keg, means that the periodic cleaning of the installation can be reduced considerably, e.g. to a minimum of twice per year, or eliminated completely.

FIGS. 7 and 8 show a second embodiment of the invention in which the main elements of the dispensing head are essentially the same as those of the embodiment of FIGS. 1 to 3. However, an additional gas inlet 31 to the cylinder 16 is provided to enable gas to be supplied to the cylinder 16 below the piston 28 so that the valve member 18 can be moved positively to its upper position. The head can be used in an assembly similar to that of FIGS. 4, 5, or 6, suitable additional control valves being provided to control the supply of gas to the additional control inlet 31.

FIGS. 7 and 8 also illustrate the provision of a handle 80 to enable the automatic rinsing operation to be overridden manually. The handle 80 is pivotable between a first position (FIG. 7) in which it does not interfere with the movement of the valve member 18 and a second position (FIG. 8) in which a collar 82 sliding on an extension of valve member 18 engages an abutment 84 on the valve member to hold it its lowermost position.

As mentioned above, the adaptor 12 of the dispensing head of each embodiment can be modified to suit any of the various keg tapping systems in use. For example, FIGS. 9 and 10 illustrate the modified form of the adaptor for two such tapping systems.

It will be appreciated that instead of water any other liquid or gas suitable for rinsing could be used, a supply of the liquid or gas under pressure being connected to the appropriate inlet of the dispensing head. It will also be appreciated that modifications could be made in the described embodiments. For example, other means could be provided for effecting the necessary movement of the valve member of the dispensing head, such as an electromagnetic device acting directly on the valve member and controlled from a switch near the dispensing tap.

I claim:

1. An installation for dispensing liquid from a container, comprising a dispensing head adapted to be fitted to the container having a valve plunger with which the dispensing head co-operates to enable liquid in the container to be dispensed through the dispensing head under pressure of a gas supplied to the container through the dispensing head, a source of pressurising gas connected to gas inlet means of the dispensing head and a dispensing tap connected to outlet means of the dispensing head through a length of delivery pipe, wherein the dispensing head has rinsing fluid inlet means connected to a source of a rinsing fluid and a valve member movable between a first position in which the rinsing fluid inlet means is closed, the gas inlet means is in communication with the interior of the container to which the dispensing head is fitted and the outlet means is in communication with the interior of the container through the valve plunger so that liquid is dispensed from the container through the dispensing tap, and a second position in which the outlet means is disconnected from the interior of the container and placed in communication with the rinsing fluid inlet means so that rinsing fluid flows through the outlet means, the delivery pipe and the dispensing tap, and wherein the installation includes control means operable from a position close to the dispensing tap for controlling the position of the valve member independently of the supply of gas to the gas inlet means.

2. An installation as claimed in claim 1, wherein the valve member is vertically movable in a body of the dispensing head between a first position in which, in use, the valve member engages the valve plunger of the container and holds it in its open position and a second position in which the valve member is disengaged from the valve plunger, the valve member including a piston movable in a cylinder forming part of the body of the dispensing head, and wherein the cylinder has a control inlet separate from the gas inlet means and connected to the course of pressurising gas through a control valve forming part of the control means so that when the control valve is open the pressure of the gas supplied to the cylinder through the control inlet surges the valve member to its first position.

3. An installation as claimed in claim 2, wherein the control valve is a manually operated valve positioned close to the dispensing tap.

4. An installation as claimed in claim 2, wherein the control valve is positioned in the region of the dispensing head and the source of pressurising gas, and in that auxiliary control means are provided for operating the control valve from a position close to the dispensing tap.

5. An installation as claimed in claim 4, wherein the auxiliary control means comprises a further control valve positioned close to the dispensing tap and connected in a branch line between the source of pressurising gas and the first control valve, the first control valve being operable by pressure of gas supplied to it through the further control valve.

6. An installation as claimed in claim 4, wherein the control valve is a solenoid-operated valve and the auxiliary control means comprises an electrical circuit for controlling operation of the valve, the electrical circuit including an operating switch positioned close to the dispensing tap.

7. An installation as claimed in claim 4, wherein the control valve is adapted to interrupt the supply of rinsing fluid to the further inlet of the dispensing head when pressurising gas is supplied to the control inlet to hold the valve member in its first position.

8. A dispensing head adapted to be fitted to a container having a valve plunger with which the dispensing head co-operates to enable liquid in the container to be dispensed through the dispensing head under pressure of a gas supplied to the container through the dispensing head, the dispensing head having first gas inlet means for connection to a source of the pressurising gas, outlet means adapted to be connected to a source of rinsing fluid, a valve member movable between a first position in which the rinsing fluid inlet means is closed, the first gas inlet means is in communication with the interior of the container to which the dispensing head is fitted and the outlet means is in communication with the interior of the container through the valve plunger so that liquid is dispensed from the container, and a second position in which the first gas inlet means is closed and the outlet means is disconnected from the interior of the container and placed in communication with the rinsing fluid inlet means so that rinsing fluid flows through the outlet means, and means for moving the valve member to said first position, comprising a piston coupled to the valve member and movable in a cylinder forming part of the body of the dispensing head, and second gas inlet means separate from the first gas inlet means and opening into the cylinder so that on supply of gas under pressure to the second gas inlet means the valve member is moved to its first position irrespective of the supply of gas to the first gas inlet means.

9. A dispensing head as claimed in claim 8 wherein the valve member is vertically movable in a body of the dispensing head so that in the first position the valve member engages the valve plunger of the container and holds it in an open position and in the second position of the valve member it is disengaged from the valve plunger.

10. A dispensing head as claimed in claim 8, wherein a further inlet to the cylinder is adapted to be connected to the source of pressurising gas so that supply of gas to the further inlet whilst supply to the second gas inlet means is cut off urges the valve member to its second position.

11. A dispensing head as claimed in claim 8, characterised in that the valve member has a longitudinal channel providing the outlet means, and a one-way valve is positioned in the channel to prevent rinsing fluid from entering the container to which the head is fitted.

* * * * *